US006074456A

United States Patent [19]

Freytag et al.

[11] Patent Number: 6,074,456

[45] Date of Patent: Jun. 13, 2000

[54] PROCESS FOR HOT BRIQUETING GRANULAR SPONGE IRON

[75] Inventors: Jochen Freytag, Usingen; Helmut Hausmann, Babenhausen; Martin Hirsch; Siegfried Schimo, both of Friedrichsdorf; Michael Ströder, Neu-Anspach; Peter Weber, Hammersbach-Marköbel, all of Germany

[73] Assignee: Metallgesellschaft Aktiengesellschaft, Frankfurt am Main, Germany

[21] Appl. No.: 09/077,780

[22] PCT Filed: Dec. 5, 1996

[86] PCT No.: PCT/EP96/05446

§ 371 Date: Dec. 21, 1998

§ 102(e) Date: Dec. 21, 1998

[87] PCT Pub. No.: WO97/21840

PCT Pub. Date: Jun. 19, 1997

[30] Foreign Application Priority Data

Dec. 9, 1995 [DE] Germany ..... 195 45 985

[51] Int. Cl.[7] ..... B02C 17/00

[52] U.S. Cl. ..... 75/436; 241/24.25

[58] Field of Search ..... 75/436; 29/426.4, 29/403.1, 403.2, 403.3; 241/23, 24.13, 24.15, 24.25

[56] References Cited

U.S. PATENT DOCUMENTS

| | | | |
|---|---|---|---|
| 3,556,772 | 1/1971 | Rausch et al. | 75/33 |
| 4,033,559 | 7/1977 | Pietsch | 266/122 |
| 4,057,978 | 11/1977 | Sato . | |
| 4,076,520 | 2/1978 | Pietsch . | |
| 4,165,979 | 8/1979 | Sanzenbacher . | |
| 5,082,251 | 1/1992 | Whipp | 266/142 |

FOREIGN PATENT DOCUMENTS

| | | |
|---|---|---|
| 1215666 | 4/1960 | France . |
| 59170213 | 9/1984 | Japan . |

OTHER PUBLICATIONS

Patent Abstracts of Japan, vol. 9, No. 21 (C–263), Jan. 29, 1985 Abstract of JP 59170213.

*Primary Examiner*—George Wyszomierski
*Assistant Examiner*—Janelle Morillo
*Attorney, Agent, or Firm*—Norris, McLaughlin & Marcus, P.A.

[57] ABSTRACT

The granular sponge iron is supplied to a roller press at temperatures of 600 to 850° C. for molding the hot briquets. There is produced a strip structure of sponge iron containing formed hot briquets, which are arranged at a distance from each other. By smashing the strip structure, the hot briquets are separated from each other, so that fragments of the strip structure are obtained. The hot briquets and at least part of the fragments are cooled to temperatures in the range from 20 to 400° C., and the cooled briquets and fragments are passed through a rotary drum. In the rotary drum, fine-grained fines of the briquets and fragments are produced. Subsequently, these fines are separated from the briquets and fragments, as they exhibit a pyrophoric behavior.

4 Claims, 1 Drawing Sheet

PROCESS FOR HOT BRIQUETING GRANULAR SPONGE IRON

DESCRIPTION

This invention relates to a process of hot briquetting granular sponge iron, where the granular sponge iron is supplied to a roller press at temperatures of 600 to 850° C. for moulding the hot briquets, and there is produced a strip structure of sponge iron by means of formed hot briquets, which are arranged at a distance from each other, from which strip structure the hot briquets are separated by smashing said structure, so that fragments of the strip structure are obtained.

A known process of this type is described in the U.S. Pat. No. 5,082,251. The hot briquets moulded by means of the roller press are directly charged into a rotary drum in the hot condition. As a result, the rotary drum is subjected to a high wear.

It is the object underlying the invention to perform the production of the hot briquets at low cost and with little equipment involved, where in particular the wear and the susceptibility to failure should be kept as small as possible. In accordance with the invention, this object is solved in the above-stated process in that upon smashing the strip structure the hot briquets and at least part of the fragments are cooled to temperatures in the range from 20 to 400° C., and preferably not more than 200° C., that the cooled briquets and fragments are passed through a rotary drum, where the briquets and the fragments produce fine-grained fines, and that the fines are separated from the briquets and fragments.

Granular and in particular fine-grained sponge iron is very pyrophoric, so that it can only be employed under a protective gas atmosphere. A useful protective gas is, for instance, nitrogen or carbon dioxide or a mixture of these inert gases. When the granular sponge iron has been briquetted, it is no longer or hardly pyrophoric, and the handling of the briquets and their storage are very much simplified. At temperatures of 600 to 850° C., and for instance in the form in which the sponge iron comes from a reduction plant, the same can be moulded in a known manner to form hot briquets by means of a roller press. There is produced a strip structure of sponge iron with attached hot briquets arranged at a distance from each other. This strip structure is subsequently smashed, in order to separate the hot briquets from each other, so that fragments of the strip structure are obtained. When these fragments are large enough, it is expedient to process them together with the hot briquets.

The sponge iron suitable for the process can be produced in any kind of known iron ore reduction plant. The sponge iron usually has an Fe content of 90 to 98 wt-%.

In the process in accordance with the invention it is important that the hot briquets and the fragments are cooled before they are introduced into the rotary drum. By means of this cooling it is avoided that hot material is charged into the drum, and that the rotary drum must be designed for processing such hot material. For the wear in the drum turned out to be very high when hot material having temperatures above 400° C. is charged into the rotary drum, and the rotary drum must be repaired frequently. Due to such frequent repair it is necessary to have a substitute rotary drum available, when a continuous production of hot briquets is desired. The process in accordance with the invention, on the other hand, has the advantage that only cooled material is supplied to the rotary drum, so that less wear is applied on the drum and the operation need only rarely be stopped for repair. At the same time it is now possible that the cooled material need not be stored temporarily in a container under a protective gas during the repair of the drum, and that the material can be supplied to the rotary drum when the repair has been terminated. In this case a substitute drum is not required.

Embodiments of the process will now be explained with reference to the drawing, wherein.

Figure 2:
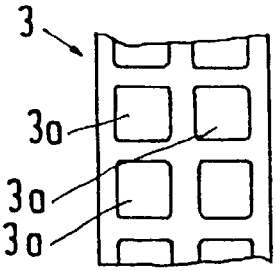
FIG. 2 shows the strip structure of the sponge iron coming from the roller press in an elevation.

In the reservoir 1 hot granular sponge iron is contained at temperatures in the range from 600 to 850° C., and usually 650 to 750° C. Since the sponge iron is very pyrophoric, it is kept under an inert gas atmosphere here and also in the following processing steps, as it is known per se and will not be explained in detail here. The hot sponge iron comes, for instance, from a reduction furnace or heater 6 and is supplied via line 6*a*. From the reservoir 1 the sponge iron continuously flows to a roller press 2, where the sponge iron is pressed to a strip structure 3 with hot briquets released from the mould. FIG. 2 shows the strip structure 3 and the hot briquets 3*a* in an elevation.

The strip structure 3 is moving downwards over a stationary impact surface 4, where it is smashed by means of a rotating hammer roller 5. The roller 5 is provided with beater cams 5*a* which during the rotation of the roller have a crushing effect on the strip structure 3 in particular in the areas between the briquets 3*a*. In this way, hot briquets and fragments of different grain sizes drop from the impact surface 4 onto a screen 7, so as to separate the fine grain. This fine grain, whose maximum grain size lies in the range between 2 and 6 mm, is withdrawn via line 8 and reused. For this purpose, the fine grain in line 8 can first of all be passed through a cooler 22, which is designed for instance as a water-cooled screw conveyor. At temperatures of preferably not more than 200° C. the fine grain reaches a pneumatic conveyor path 21, which is fed with inert gas from line 23 and moves the fine grain upwards to the reduction furnace or heater 6. As an alternative, the fine grain of line 8 can be recirculated uncooled directly to the container 17 along the transport path 24 indicated in broken lines. Through the passage 9 the hot briquets and coarse fragments first of all drop into a cooler 10, where they are cooled to temperatures in the range from 50 to 400° C., and usually not more than 200° C. The cooler 10 represented only schematically in FIG. 1 can be designed for instance as a water bath or as a water-injection cooler, but cooling by means of cold gas is also possible.

Figure 3:
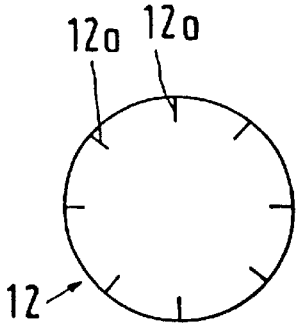
FIG. 3 shows a cross-section through the interior of the rotary drum in an enlarged schematic representation.

Cooled briquets and fragments leave the cooler 10 through the passage 11 and are charged into a rotary drum 12. On its inside, the drum 12 has axially parallel pick-up fins 12*a*, as this is schematically illustrated in FIG. 3. When the drum 12 is rotated about its longitudinal axis, the material in its interior is agitated intensively, so that there is also acting a falling load, where edges and corners of the bodies are rounded off and fine-grained fines are produced. This rounding off reduces the risk that during the future transport fine-grained fines are formed, which exhibit a pyrophoric behaviour. To expose the briquets in the rotary drum to an intensive falling load, it may be recommended to make the diameter of the drum larger than the length thereof. In a manner not represented here, the rotary drum 12 may also be designed for cooling the material to be treated, e.g. by means of a cooling water jacket.

Through the passage 14, the material agitated in the drum 12 at temperatures of 20 to 150° C., and usually not more than 100° C., drops into a screen device 15, where through a large screen 15*a* briquets are separated first of all, which are then withdrawn via line 16. Fragments and fines drop onto the second screen 15*b,* where the relatively coarse fragments having a grain size of e.g. at least 3 to 6 mm are separated and withdrawn via line 17. Fine grain is withdrawn via line 18 and usually together with the fine grain of line 8 recirculated to the reduction furnace or heater 6. The briquets and fragments of lines 16 and 17 are supplied to an intermediate store not represented here, where now a storage under inert gas is no longer necessary.

Figure 1:
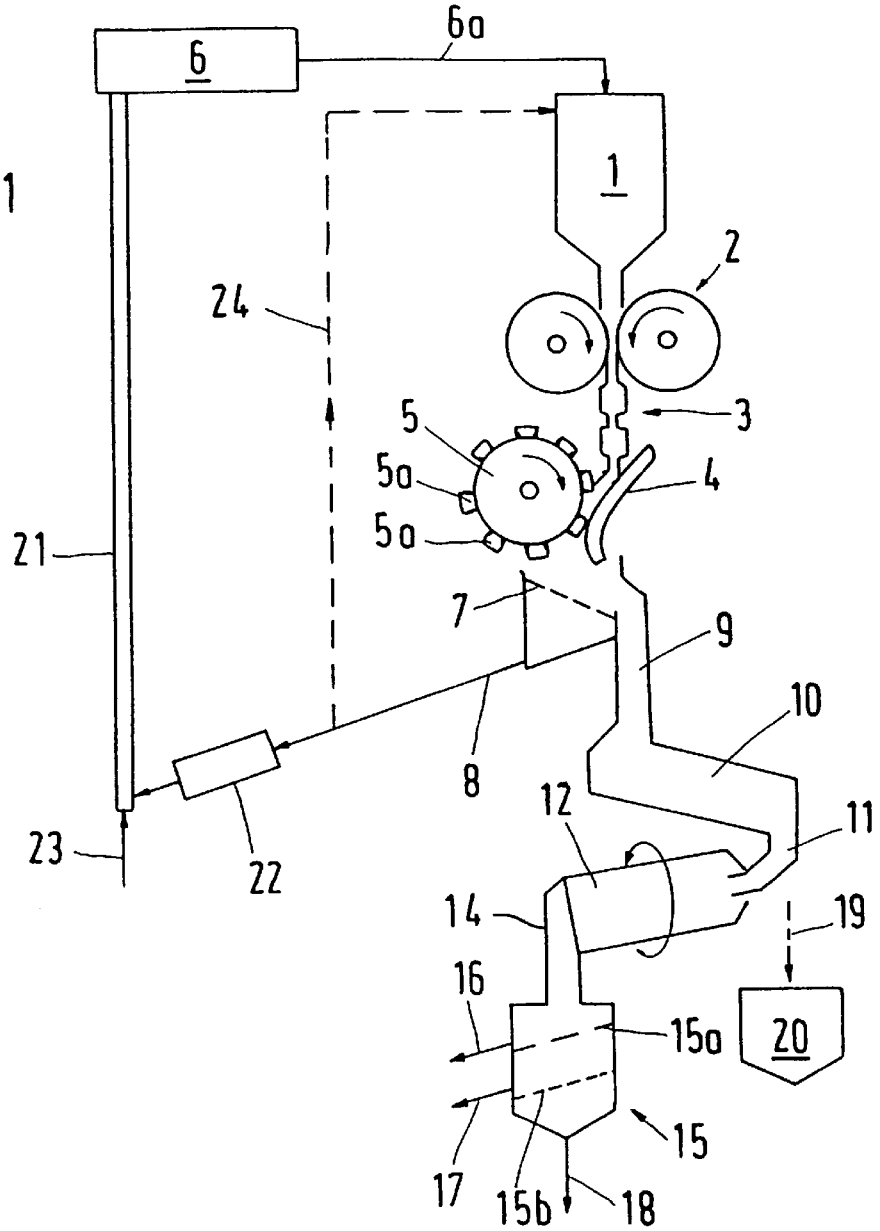
FIG. 1 represents the flow diagram of the process.

In FIG. 1 an intermediate container 20 or store is indicated, to which cooled material from the cooler 10 is supplied in the direction of the broken line 19, when the rotary drum 12 must be put out of operation for a certain period for repair purposes. When the drum 12 is again ready for operation, the material from the container 20 or store is charged into the drum 12 for further processing. As has already been mentioned, all apparatuses, containers and lines containing fine grain must be kept under protective gas.

EXAMPLE

The process is started with granular sponge iron, which is present in the reservoir 1 at a temperature of 720° C. and is treated in a plant corresponding to the drawing, but without the parts 21, 22, and 24. The data have been calculated in part. 67 t sponge iron per hour flow from the reservoir 1 to the roller press 2. Further particulars concerning the amounts and temperatures of the sponge iron are indicated in the following table.

| Reference numeral | 8 | 9 | 11 | 16 | 17 | 18 |
|---|---|---|---|---|---|---|
| Amount (t/h) | 1.7 | 65.3 | 65.1 | 62.1 | 1.3 | 1.7 |
| Temperature (° C.) | 680 | 120 | 120 | 90 | 90 | 90 |

In the cooler 10, the material is placed in a water bath, where adhering fine dust is withdrawn together with the cooling water. The rotary drum 12 is cooled with water spread over the outer shell. The screen 15*a* separates briquets having a diameter of at least 12 mm, and the fragments of line 17 lie in the range from 4 to 12 mm. The screen 7 has holes with a diameter of 4 mm.

What is claimed is:

1. A process of hot briquetting granular sponge iron, which comprises supplying granular sponge iron to a roller press at temperatures of 600 to 850° C., molding it into hot briquets, and producing a strip structure of hot briquets, on which the briquets are arranged at a distance from each other, and then separating the hot briquets from the strip structure by smashing said structure, so that fragments of the strip structure are obtained, cooling the hot briquets and at least part of the fragments to temperatures in the range from 20 to 400° C., and passing the cooled briquets and fragments through a rotary drum, to produce fine-grained fines of the briquets and fragments, and separating the fines from the briquets and fragments.

2. The process according to claim 1, wherein the briquets, the fragments and the fines are cooled in the rotary drum.

3. The process according to claim 1, wherein the briquets, the fragments and the fines are withdrawn from the rotary drum at temperatures in the range from 20 to 150° C.

4. The process of claim 1, further comprising separating a fine grain fraction, having an upper grain size limit of 2–6 mm, from the fragments upon smashing the strip structure.

* * * * *

UNITED STATES PATENT AND TRADEMARK OFFICE

CERTIFICATE OF CORRECTION

PATENT NO. : 6,074,456
DATED : June 13, 2000
INVENTOR(S) : Freytag et al.

It is certified that error appears in the above-identified patent and that said Letters Patent is hereby corrected as shown below:

Title page,
Item [54], "References Cited", and under "U.S. PATENT DOCUMENTS",
Line 4, delete "4165,979" and substitute -- 4,165,978 --

Signed and Sealed this

Twenty-sixth Day of February, 2002

*Attest:*

*Attesting Officer*

JAMES E. ROGAN
*Director of the United States Patent and Trademark Office*